United States Patent [19]

Shima

[11] 4,073,164

[45] Feb. 14, 1978

[54] GLOVE KNITTING APPARATUS

[75] Inventor: Masahiro Shima, Wakayama, Japan

[73] Assignee: Shima Idea Center Company Ltd., Wakayama, Japan

[21] Appl. No.: 728,440

[22] Filed: Sept. 30, 1976

[30] Foreign Application Priority Data

Oct. 4, 1975 Japan ..... 50-120060

[51] Int. Cl.[2] ..... D04B 7/34

[52] U.S. Cl. ..... 66/65; 66/174

[58] Field of Search ..... 66/45, 174, 96 R, 147, 66/148, 64, 65

[56] References Cited

U.S. PATENT DOCUMENTS

| | | | |
|---|---|---|---|
| 850,786 | 4/1907 | Rieffel et al. | 66/64 |
| 3,115,760 | 12/1963 | Pierce | 66/65 |
| 3,677,037 | 7/1972 | Krause | 66/147 |
| 3,788,103 | 1/1974 | Asai | 66/65 |
| 3,805,557 | 4/1974 | Seegers | 66/147 |
| 3,916,647 | 11/1975 | Yabuta | 66/65 |

*Primary Examiner*—Mervin Stein
*Assistant Examiner*—A. M. Falik
*Attorney, Agent, or Firm*—Whittemore, Hulbert & Belknap

[57] ABSTRACT

A loop support device of the present invention is used for transferring loops from needles of one needle bed to the needles of the opposite bed in a flat knitting machine. The loop support device comprises a plate-like main loop support having a notch which main loop support is slidably mounted below the lower face of hooks of the needles and a plurality of rodlike auxiliary loop supports which are disposed parallel to the top edge of the main loop support which can project slidably toward the notch in the main loop support.

1 Claim, 24 Drawing Figures

FIG. 4
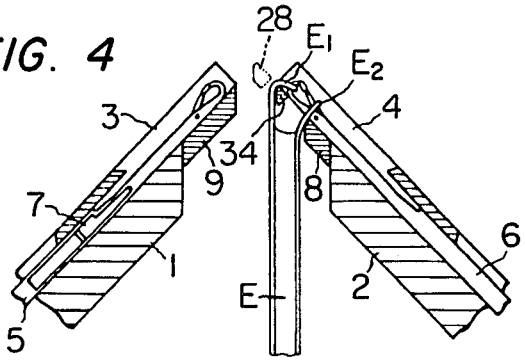
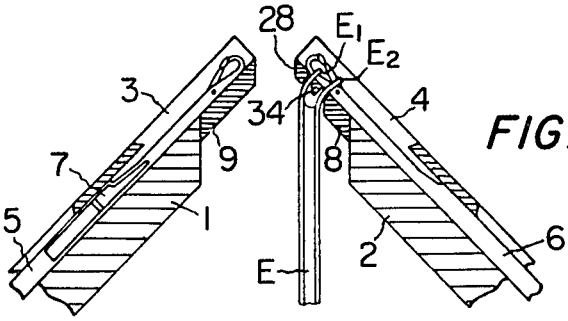
FIG. 5
FIG. 6
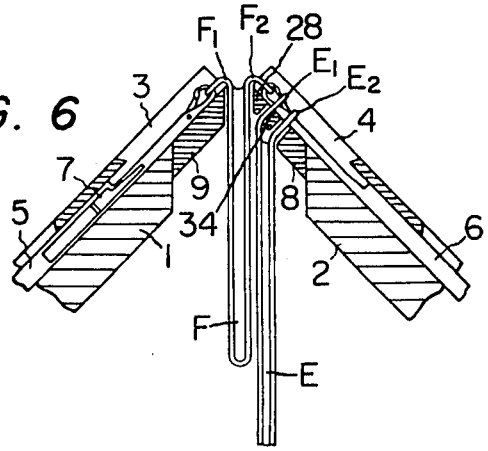

GLOVE KNITTING APPARATUS

SUMMARY OF THE INVENTION

The present invention relates to a loop support device in a flat knitting machine. The loop support device may be applied for knitting gloves most conveniently.

It is a primary object of the present invention to provide a loop support device according to which, in continuously knitting a glove by connecting a trunk portion for four fingers fashioned in a bag-like shape with a thumb portion in a glove knitting machine, loops of said trunk portion, which have been transferred, are turned down assuredly and while these stitches are kept regularly in the loopy state, the thumb portion is then knitted at the same height as the height of the loops of said trunk portion for four fingers. In order to attain this object, according to the present invention, there is provided a loop support device characterized in that a plurality of auxiliary loop supports for holding loops of an already fashioned bag-like knitted fabric are disposed in addition to a main loop support, so that these auxiliary loop supports are advanced to the transfer position instead of the main loop support.

BRIEF DESCRIPTION OF DRAWINGS

FIGS. 1 to 6 are sectional views of the knitting machine provided with the loop support device of the present invention, which illustrate the sequential order of steps of the knitting operation;

DETAILED DESCRIPTION OF THE INVENTION

Figure 1:
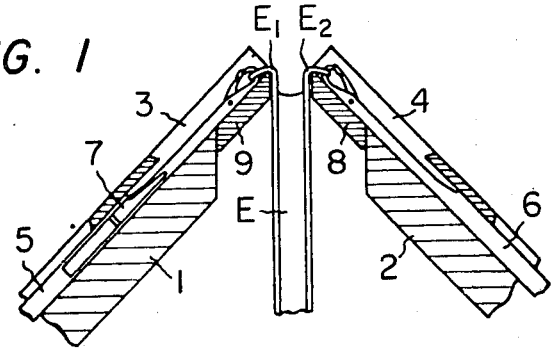

One embodiment of the present invention will now be described in detail by reference to the accompanying drawings.

Needle beds 1 and 2 have needle grooves 3 and 4 perforated on the upper faces thereof, and knitting needles 5 and 6 are inserted into these grooves 3 and 4. The knitting needle 5 is a stitch transfer needle and has a spring 7 on the side thereof. Main loop supports 8 and 9 are supported below the lower faces of the top portions of the needle beds 1 and 2 by a base 10. The base 10 is slidably movable in the direction of the rows of needle heads in the needle beds 1 and 2 by means of a rod 11 connected to a driving source (not shown). A notch 12 is formed on the main loop support 8 on the side opposite to the stitch transfer needle 5, namely on the loop-receiving side. The width of the notch 12 is decided according to the number of the stitch transfer needles and the notch 12 is formed so that it has a width a little larger than the width of the row of these stitch transfer needles. A base plate 13 for the auxiliary loop supports is screwed to be adjacent to the side portion of the notch 12. Cam grooves 18 and 19 having portions 16 and 17 parallel to the top edges 14 and 15 of the main loop supports 8 and 9 and oblique portions connecting the portions 16 and 17 are formed on the base plate 13 for the auxiliary loop supports, and a guide 22 for the auxiliary loop supports is fixed to the upper face of the base plate 13 by screws 20 and 21 slidably fitted in the grooves 18 and 19. The guide 22 is always urged to the left in the drawings by a spring 25 spread between a screw 23 fitted in said guide 22 and a screw 24 fitted in the base plate 10. Long and short grooves 26 and 27 for the auxiliary loop supports are formed on the back face of the guide 22. An auxiliary loop support 28 having a sharpened head on the top end and a dull knife-edge like upper edge thereof is slidably mounted in the groove 26, and a supporting piece 29 is fixed to the other end portion of the auxiliary loop support 28. An end portion of a wire 30 is engaged with the supporting piece 29 and a screw 31 is fitted in the supporting piece 29. A spring 33 is spread between this screw 31 and a screw 32 fitted in the guide 22 to always urge the auxiliary loop support 28 to the left in the drawings. An auxiliary loop support 34 is formed in like manner as the auxiliary loop support 28 is formed and fixed in the groove 27.

The operation of the loop support device of the present invention having the above structure will now be described in detail.

Figure 7:
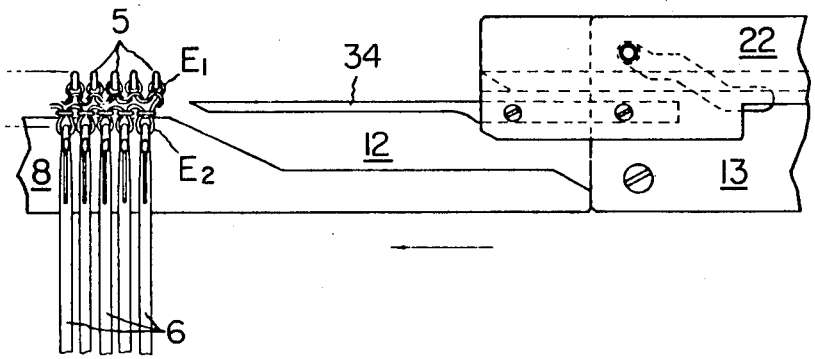
FIGS. 7 to 12 are partial plan views of the knitting machine corresponding to FIGS. 1 to 6, respectively.

In knitting a glove, a forefinger tube A, a middle finger tube B, a ring finger tube C, a little finger tube D, a trunk portion E for four fingers, a thumb portion F, a palm portion G and a wrist portion H are sequentially fashioned. When knitting of the trunk portion E is completed and knitting of the thumb portion is started, loops of the trunk portion E hung on the stitch transfer needles 5 should be transferred to the knitting needles 6. For this loop transfer, the knitting operation should be interrupted. The state where knitting of the trunk portion E is completed is shown in FIGS. 1 and 7. In this state, loops $E_1$ hung on the stitch transfer needles 5 should be transferred to the knitting needles 6. This steps will now be described in order. Incidentally, in FIG. 7, about 10 needles positioned on the right side of the needle bed are used for formation of the thumb portion.

Figure 2:
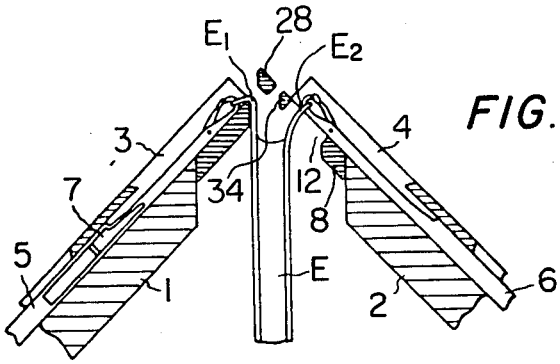
Figure 3:
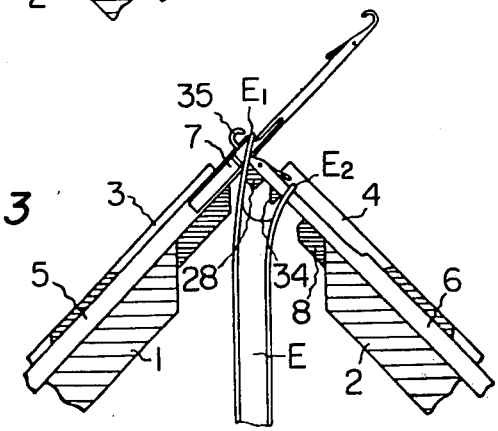
Figure 8:
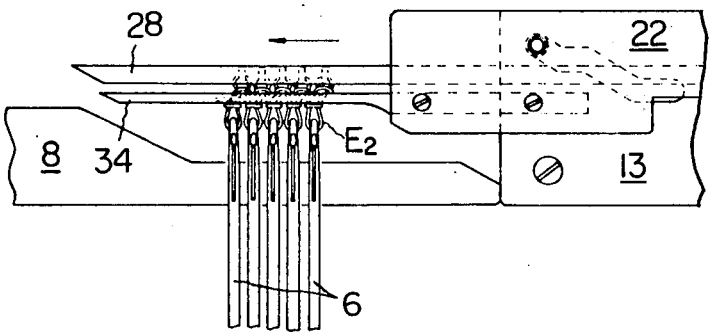
Figure 9:
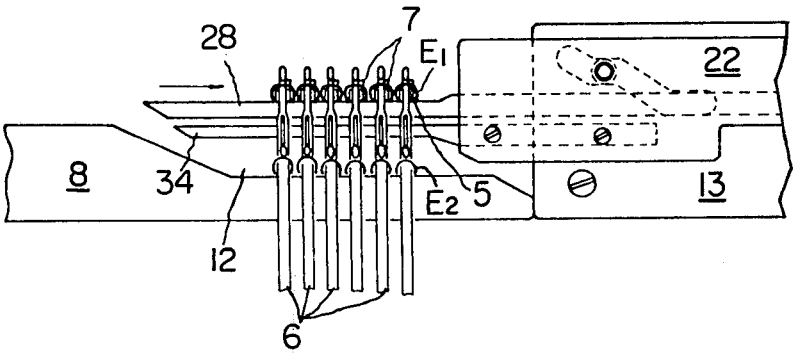
Figure 10:
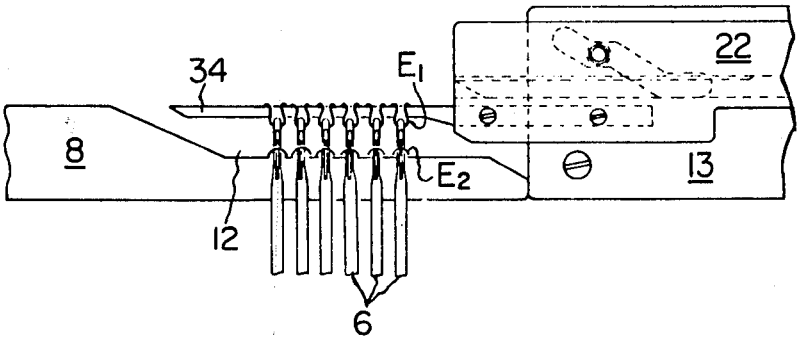
Figure 11:
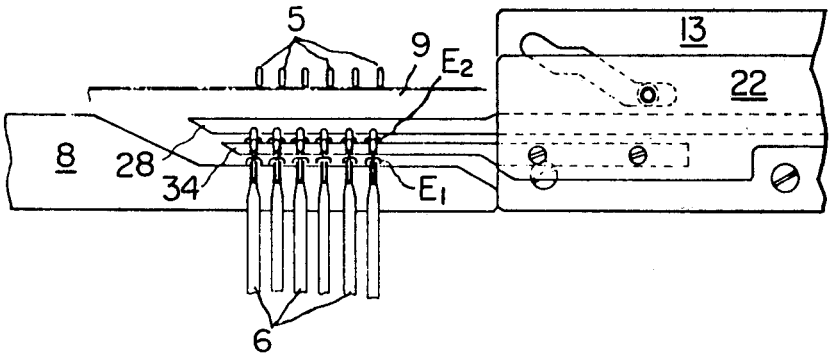
Figure 12:
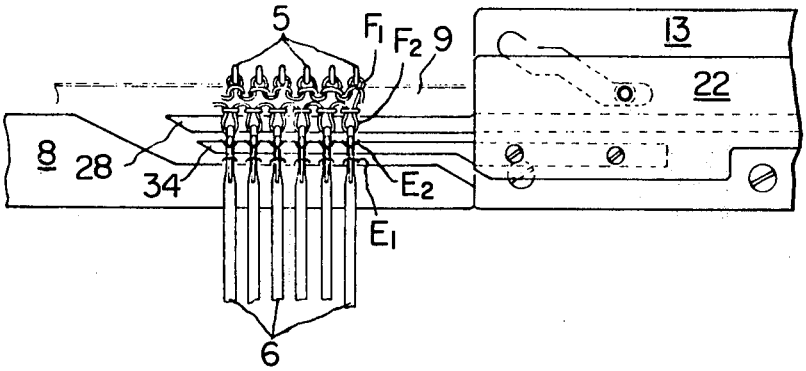
Figure 13:
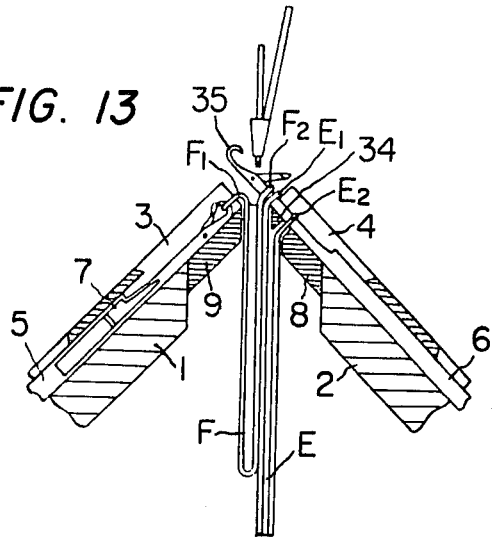
FIGS. 13 to 16 are sectional views of the knitting machine of the present invention, which illustrate the steps of the knitting operation continued from those shown in FIGS. 1 to 6.
Figure 14:
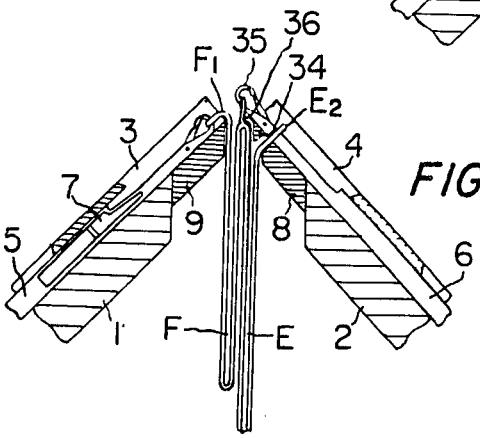
Figure 15:
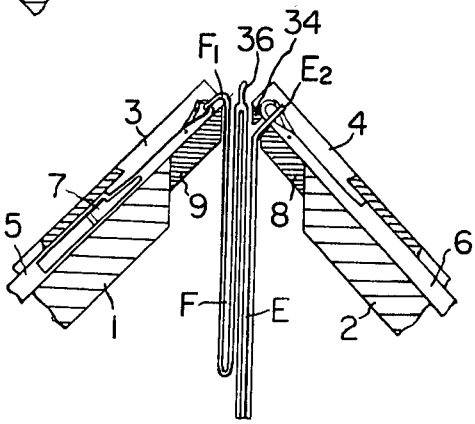
Figure 20:
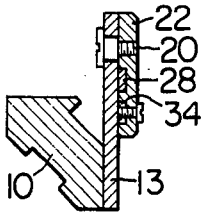
FIG. 20 is a sectional view taken along the line XX — XX in FIG. 18.
Figure 21:
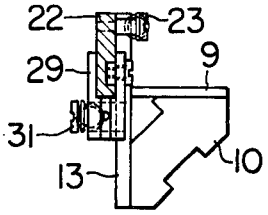
FIG. 21 is a sectional view taken along the line XXI — XXI in FIG. 19.
Figure 22:
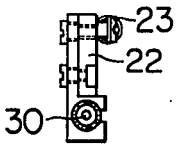
FIG. 22 is a side view of the auxiliary loop support device.
Figure 23:
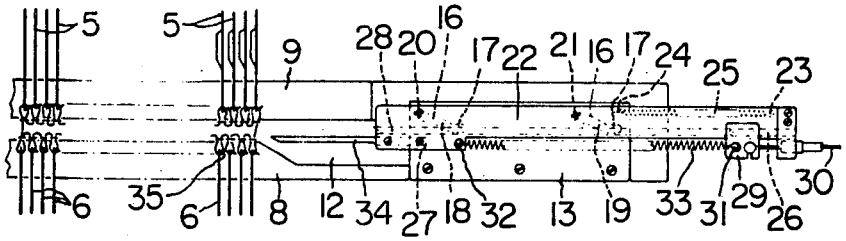
FIG. 23 is a plan view showing the positional relation between the loop support device and knitting needles.
Figure 16:
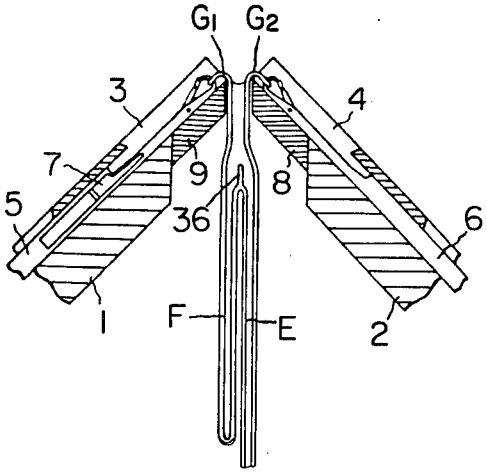
Figure 24:
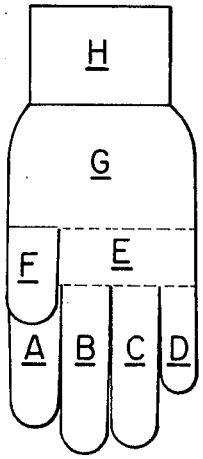
FIG. 24 is a view diagrammatically showing a glove.
Figure 17:
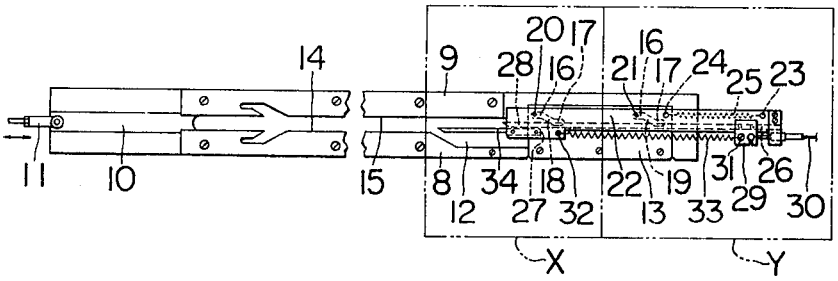
FIG. 17 is a plan view showing the entire structure of the loop support device.
Figure 18:
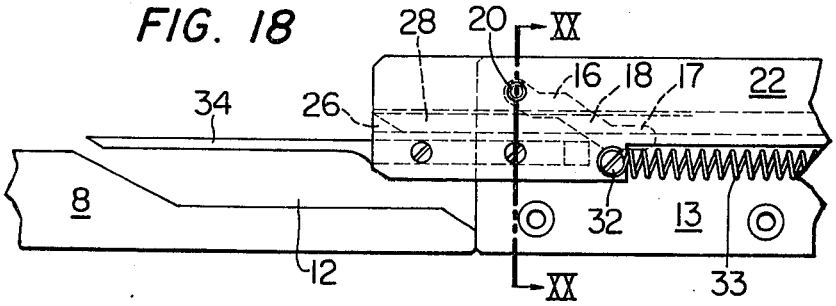
FIG. 18 is a partially expanded view of an auxiliary loop support device in the X-portion in FIG. 17.
Figure 19:
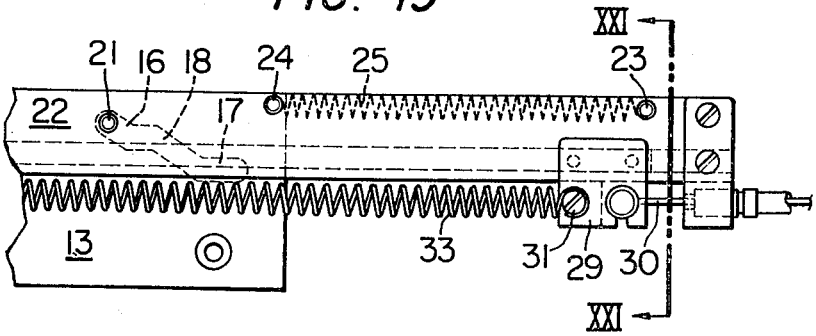
FIG. 19 is a partially expanded view of an auxiliary loop support device in the Y-portion in FIG. 17.

In the state shown by FIGS. 1 and 7, when the rod 11 is pulled by a suitable mechanism (not shown), the base 10 is moved to the left and the base plate 13 for the auxiliary loop supports is also moved to the left, and they are stopped at such positions that the knitting needles for knitting the thumb portion come to face the notch 12 of the main loop support 8. At this point, since the wire 30 is loosened by a suitable mechanism (not shown), the spring 33 is contracted and the auxiliary loop support 28 is extended from the auxiliary loop support guide 22 through the supporting piece 29, whereby the state shown in FIGS. 2 and 8 is attained. Subsequently, the base 10 is moved to the left and the auxiliary loop support guide 22 comes to hit on the end portion of the needle bed 1, whereby the movement of the guide 22 is stopped. However, since the base 10 is still moved to the left, the auxiliary loop support guide 22 is kept in the state moved along the cam grooves 18 and 19. Accordingly, the auxiliary loop supports 28 and 34 are slightly lowered and intruded in the interior of the notch as shown in FIGS. 3 and 9. Then, with advance of the carriage, the knitting needles 5 and 6 are raised and are caused to cross each other at the transfer point, and the hooks 35 of the knitting needles 6 is allowed to pass through the spring 7, whereby they are engaged with the loops $E_1$ (see FIGS. 3 and 9). Then, the wire 30 is pulled by a suitable mechanism (not shown) to retreat the auxiliary loop support 28 into the auxiliary loop support guide 22, and the stitch transfer needles 5 are lowered to complete the transfer of the loops $E_1$ to the knitting needles 6. At this point, the loops $E_1$ of the knitted fabric of the trunk portion E for four fingers are engaged with the auxiliary loop support 34 and the loops $E_2$ are carried by the notch 12 of the main loop support 8 (see FIGS. 4 and 10). Then, the base 10 is further moved to the left, and the auxiliary loop support guide 22 is slid along the cam grooves 18 and 19 and is stopped at a lowermost position. Synchronously with this descending movement, the auxiliary loop support 28 is advanced by the operation of the wire 30 to push up loops $E_1$ and $E_2$ of the knitted fabric E (see FIGS. 5 and 11). At this point, the height of the upper end edge of the auxiliary loop support 28 is the same as the height of the top end edge 14 of the main loop support 8. In this state, knitting of the thumb portion F is initiated by the knitting needles 5 and 6 (see FIGS. 6 and 12), and when knitting of the thumb portion F is completed, the auxiliary loop support 28 is retreated in the auxiliary loop support guide 22 and the base 10 is moved to the right to return the auxiliary loop support guide 22 to a position of the medium height shown in FIGS. 10 and 13. Then, the loops $E_1$ of the knitted fabric of the trunk portion are combined with the loops $F_2$ of the knitted fabric F of the thumb portion, and knitting of a waste course stitches 36 is completed (see FIGS. 14 and 15). Then, the base 10 is moved to the right to take off the notch 12 from the knitting needles 5 and 6 completely (see FIG. 16), and palm portion G and wrist portion H are knitted.

In the device of the present invention, as detailed hereinbefore, a plurality of auxiliary loop supports are used and in the stitch-transferring operation, loops of the knitted fabric are pushed down by these loop supports and these auxiliary loop supports act also as loop supports for a fabric being newly knitted. Accordingly, a regularly arranged knitted structure can be obtained when the device of the present invention is employed.

What is claimed is:

1. A loop support device for a flat knitting machine comprising a plate-like main loop support which is provided with a notch extending along the upper edge in the one end portion thereof and is mounted below the lower face of the hooks of needles to be slid along the row of the hooks of needles, and a plurality of rod-like auxiliary loop supports which are disposed to be adjacent to the notch and parallel to the upper edge of the main support and which may be projected slidably toward the notch independently.

* * * * *